US006548785B1

(12) United States Patent
Rius et al.

(10) Patent No.: US 6,548,785 B1
(45) Date of Patent: Apr. 15, 2003

(54) PRESSING IRON WITH RESIDUAL HEAT WARNING DEVICE

(75) Inventors: Antonio Rebordosa Rius, Barcelona (ES); Miguel Vázquez, Barcelon (ES); Remedios Pozo-Marin, Barcelona (ES); Juan Carlos Coronado Sanz, Barcelon (ES); Candelario Martinez Lopez, Hospitalet (ES)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/498,548

(22) Filed: Feb. 4, 2000

(30) Foreign Application Priority Data

Feb. 5, 1999 (DE) ..... 199 04 815

(51) Int. Cl.[7] ..... D06F 75/10

(52) U.S. Cl. ..... 219/248; 38/75; 219/251; 116/101

(58) Field of Search ..... 219/248, 506, 219/257, 251; 38/74, 82, 75; 116/101, 216, 221; 374/141

(56) References Cited

U.S. PATENT DOCUMENTS

| | | | | | |
|---|---|---|---|---|---|
| 204,637 | A | * | 6/1878 | Van Gumster | 38/75 |
| 448,066 | A | * | 3/1891 | Nicolaus | 38/75 |
| 884,973 | A | * | 4/1908 | Ayer | 38/75 |
| 1,280,709 | A | * | 10/1918 | Glass | 38/75 |
| 1,403,432 | A | * | 1/1922 | McGilvray et al. | 38/75 |
| 1,491,580 | A | * | 4/1924 | Bognar | 38/75 |
| 1,577,127 | A | * | 3/1926 | Kaltenback et al. | 38/75 |
| 1,625,014 | A | * | 4/1927 | Amodio | 38/75 |
| 1,718,403 | A | * | 6/1929 | Bolf | 38/75 |
| 2,201,745 | A | * | 5/1940 | Sparklin | 38/75 |
| 2,569,259 | A | * | 9/1951 | Purpura | 38/75 |
| 3,827,301 | A | * | 8/1974 | Parker | 374/162 |
| 5,117,092 | A | * | 5/1992 | Shimizu et al. | 219/247 |
| 6,399,919 | B1 | * | 6/2002 | Wu | 219/248 |

FOREIGN PATENT DOCUMENTS

| | | | |
|---|---|---|---|
| EP | 225298 | * | 6/1987 |
| EP | 603969 | * | 6/1994 |
| FR | 2 726 727 | | 5/1996 |
| GB | 566512 | * | 1/1945 |
| GB | 2064595 | * | 6/1981 |
| GB | 2221925 | * | 2/1990 |
| GB | 2289899 | * | 2/1995 |
| JP | 03-173600 | | 7/1971 |
| JP | 59-14898 | * | 1/1984 |
| JP | 59-214500 | * | 12/1984 |
| JP | 61-154600 | * | 7/1986 |
| JP | 62-142598 | | 6/1987 |
| JP | 4-259500 | * | 9/1992 |
| JP | 7-47200 | * | 2/1995 |
| JP | 7-163798 | * | 6/1995 |
| JP | 9-168700 | * | 6/1997 |
| WO | 8203520 | * | 10/1982 |

* cited by examiner

*Primary Examiner*—John A. Jeffery
(74) *Attorney, Agent, or Firm*—Fish & Richardson PC

(57) ABSTRACT

The invention is directed to a steam iron (1) equippped with an electrically heatable soleplate (9) and having a residual heat warning device (16) which operates preferably independently of the line voltage and issues a flashing warning signal via a light emitting diode (17) when the temperature of the soleplate (9) exceeds a threshold temperature of about 60° C. Due to a capacitor which is chargeable during operation of the iron, a preferred warning system is operable also when the iron is disconnected from the supply after use.

24 Claims, 2 Drawing Sheets

PRESSING IRON WITH RESIDUAL HEAT WARNING DEVICE

BACKGROUND OF THE INVENTION

This invention relates to a pressing iron, in particular a steam iron, having an electrically heatable soleplate.

As is known, following use for ironing or the like, the soleplate and, where applicable, other parts of pressing irons arranged in close proximity to the soleplate continue to be relatively hot for some time also when the pressing iron is turned off or unplugged from an electrical outlet. In particular shortly after the heating unit is turned off, touching the iron's soleplate may cause injuries such as burns. There is also the risk that heat-sensitive objects might be damaged or destroyed on contact with a pressing iron that has not yet cooled off sufficiently. Therefore, it is general practice to allow a pressing iron to cool for a while after use before it is packed away in its designated storage place. In doing so, a user has difficulty finding out, without touching the pressing iron, the moment when the iron has cooled down sufficiently to allow safe further handling.

SUMMARY OF THE INVENTION

It is an object of the present invention to provide a pressing iron affording particular handling safety.

According to the present invention a pressing iron constructed in particular as a steam iron having a preferably electrically heatable soleplate is equipped with a residual heat warning device configured such as to issue one or several warning signals readily perceptible by a user when the temperature of the soleplate exceeds a threshold temperature. The residual heat warning device, which operates independently of a heating signal, if any, of a thermostat device and is in a position to deliver visual and/or audible warning signals directly perceptible to a user without the intermediary of any further devices, is activated in the presence of temperatures exceeding the threshold temperature, while at temperatures below the threshold temperature being capable of changing over to a condition in which it is either deactivated or, alternatively, issues one or several signals clearly distinguishable from the warning signal. This enables a user to recognize at any time directly when cautious handling is still required.

In a particularly preferred embodiment the residual heat warning device is operable independently of the line voltage so that, for example, an electrical appliance equipped with such a device is in a position to issue warning signals also when the supply of electricity has been turned off or the appliance plug has been pulled. Particularly in electrical appliances in which a pulled appliance plug can be readily seen, the risk involved with the potentially still hot appliance might not be recognized.

The line voltage independent operating capability of a residual heat warning device is particularly useful in pressing irons which conventionally have no power switch, operation being instead started and stopped by plugging and unplugging the appliance cord.

Particularly advantageously, a line voltage independent operation is rendered possible in one embodiment in which the residual heat warning device is electrically operable by providing at least one storage device for the storage of electric energy in order to supply the residual heat warning device with energy. This storage device may be, for example, a primary/secondary battery or a similar storage medium which has been charged independently of the electrical appliance. Preferably the storage device is an integral part of the residual heat warning device and configured such as to be rechargeable when the electrical appliance, in particular the pressing iron, is connected to the line. Thus it can be ensured that on each use of the appliance, also after prolonged periods of non-use, sufficient energy is available for operation of the residual heat warning device.

As storage medium an electrochemically operating secondary battery may be used, for exmaple. In particularly preferred embodiments the storage unit includes at least one capacitor which is preferably a high capacitance capacitor with a capacitance of more than 0.05 farad, in particular between about 0.08 and about 1.2 farad. In contrast to conventional storage by means of secondary batteries, the capacitive storage of electric energy which thereby becomes possible has, among other benefits, the advantage that a capacitor is basically usable without limits regarding the number of its charging cycles, and the stored energy remains essentially constant for the entire service life. In addition, very short charging times can be achieved. Furthermore, capacitors afford low-cost manufacture, and the hardware requirements for the use of charging capacitors may be low, making it possible to keep production costs at an overall economical level.

Where appropriate, the energy required for operation of the warning device may also be stored mechanically as, for example, by means of a spring element or the like, or energy can be generated utilizing the existence of temperature differences in the appliance, as by means of Peltier cells or the like.

Still further, sturdy and low cost embodiments may be contemplated in which the residual heat warning device is operable exclusively by mechanical means. To accomplish this, the residual heat warning device may be provided with at least one mechanical temperature sensor for detecting the temperature of the heat emitting body, meaning the soleplate, needing to be monitored, using for example, a bimetallic element experiencing defined deformations in the range of the threshold temperature. Using the effects of liquid expansion or a thermally induced phase change of a sensor material for temperature detection is also possible. The mechanical temperature sensor may be coupled to a signal device, preferably by mechanical means. This signal device may operate optomechanically, for example, as by using a color element which is movable, using in particular a sliding or swinging motion as in the manner of a flag, in response to temperature and can be observed through a window at temperatures exceeding the threshold temperature, for example. Hybrid arrangements operating, for example, with electric temperature detection and mechanical signal output or vice versa are also possible.

In a preferred embodiment the residual heat warning device has at least one visual signal device which may be provided in addition to a signal device responsible for thermostat settings and which, in a preferred embodiment, is however identical thereto. This signal device may be in particular at least one light emitting diode which, while consuming little energy, delivers in economical manner a warning signal of sufficient luminosity to be readily identifiable also in a dark environment. To enhance the warning effect and lower the energy consumption still further, provision may be made for the visual signal device to be operable intermittently, in particular as a flasher, making it possible to obtain particularly conspicuous warning signals. Where a flashing or pulsating signal or a signal alternating in some other way to indicate residual heat is used, the same signal device can be employed to advantage that is also used for indicating the heating condition of the thermostat by continuous illumination, because these signals are clearly distinguishable from each other. Alternatively or additionally, it is also possible to use, preferably, LEDs differing in color from the colors indicative of the heating condition, or to use electrically operable, audible signal devices.

At least one visual signal device may be arranged on the top side of the pressing iron, in particular on or within the handle. Alternatively or additionally, it is also possible to arrange at least one visual signal device on the bottom side of the pressing iron, for example, in the area immediately adjacent to the soleplate.

Visual signal devices arranged laterally are equally possible. The arrangement of the signal devices is advantageously such that at least one signal device is visible regardless of the position of the pressing iron and the direction from which it is customarily grasped.

It is possible for the residual heat warning device to include at least one temperature sensor for monitoring the temperature of the soleplate serving as heat emitting element, and for the residual heat warning device to be controllable or controlled in dependence upon a temperature signal from the temperature sensor. Elements suited to temperature detection may include, for example, temperature detectors with negative or positive temperature coefficient, thermocouples, suitable temperature sensitive semiconductor elements, infrared detectors, bimetallic elements, metal or fluid expansion elements or temperature sensors responsive to phase changes or the like.

Particularly preferred are embodiments in which the residual heat warning device is configured such as to deliver a warning signal upon the end of heating of the heat emitting element, that is, the soleplate, said signal being present for a predeterminable period of time, preferably independent of the actually prevailing soleplate temperature. Use may be made of the realization that a cooling process follows a substantially predictable and repeatable course, a cooling curve being essentially dependent on such conditions as the thermal capacity of the heat emitting element, the original temperature, the surface properties of the heat emitting element such as size and heat emitting capability, and the ambient temperature. If cooling curves are determined empirically for a given appliance, while taking these parameters into account, it is possible to indicate with relative accuracy a maximum cooling period after which the appliance, proceeding from the maximum operating temperature, will have reached a temperature below a threshold temperature and hence a safe range. Using a suitably connected timer, this cooling period may be utilized for maintaining and subsequently deactivating the warning signal. This enables a residual heat warning device to be provided which does not have a temperature sensing device for detecting the temperature of the heat emitting element. This makes it possible to simplify the design of electrical appliances equipped with such residual heat warning devices and minimize production costs. The storage device is configured/dimensioned in such manner that it will store an amount of energy sufficient for supply to a signal device for the entire period of time until the soleplate has cooled to a temperature below a safe threshold value. For example, an LED will keep flashing for about one hour after the power plug is pulled unless reconnected to the line voltage before this time has elapsed.

Another low-cost possibility of a line voltage independent residual heat warning device may be provided by the residual heat warning device having at least one signal device made of a thermally sensitive material, which is connected with the heat emitting element, that is, the soleplate, in heat conducting manner, being in particular directly affixed thereto, and which experiences a preferably visually perceptible property change, in particular a color change, when the temperature exceeds or drops below the range of the threshold temperature. The signal device may be formed in particular by a coat of temperature sensitive paint applied preferably laterally in the area of the soleplate. It is also possible to provide parts made of temperature sensitive plastics material in the area of the soleplate, the parts' appearance varying significantly in the range of the threshold temperature, dependently of the temperature.

Pressing irons are known in which at least one condition sensing device for detecting the position and/or the movement of the pressing iron is provided. A corresponding condition signal typically serves the function of turning off the heating unit and/or initiating an alarm signal when the appliance is placed down in a vertical position or when it is in a horizontal position without having been moved for a prolonged period. In such appliances it may be advantageous for the residual heat warning device to be operable in dependence on the condition signal, as will be explained in the following with reference to an embodiment.

In one variant, the residual heat warning device is configured in such manner that in cases where the soleplate, during use, has exceeded a critical temperature threshold lying higher than the threshold temperature, it will also issue a warning signal when the temperature subsequently drops below the threshold value. In such cases, accordingly, the warning signal is independent of the actual soleplate temperature, giving an indication that during the preceding heating cycle a hazardous temperature problem may have occurred as, for example, an excessive deviation towards elevated temperatures. Such a warning signal contributes also to enhancing the handling safety, alerting the user to potentially occurring temperature problems, hence enabling appropriate remedial action to be taken.

These and further features will become apparent not only from the claims but also from the description and the drawing, it being understood that the individual features, whether taken alone or combined in the form of subcombinations, may be implemented in an embodiment of the present invention and in other fields.

DETAILED DESCRIPTION

Figure 1:
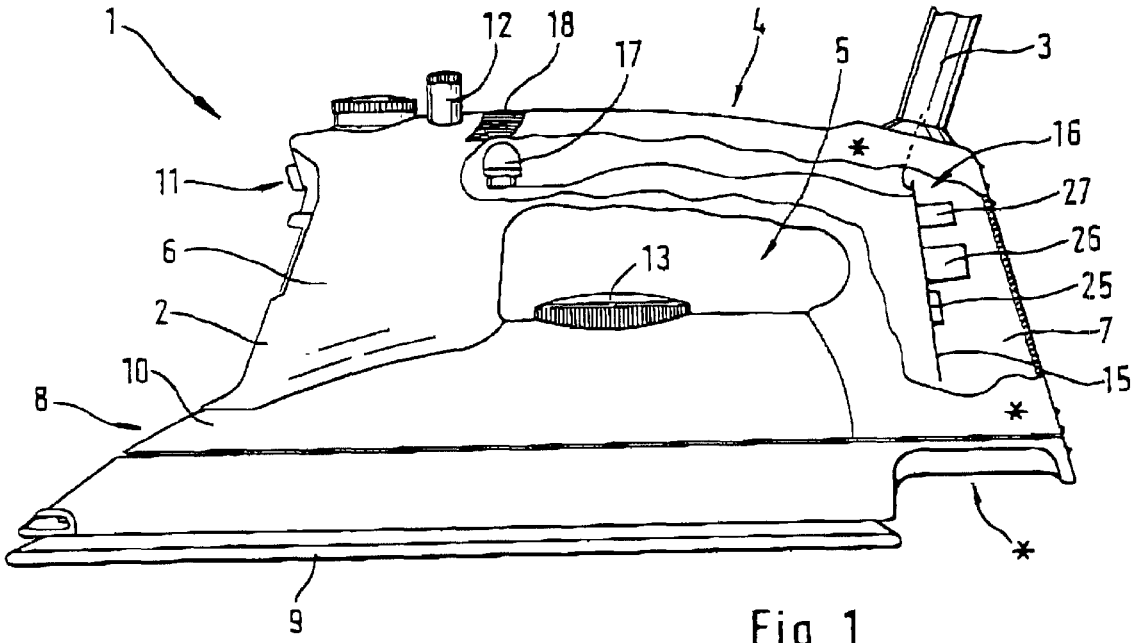
FIG. 1 is a side view of a stream iron equipped with a residual heat warning device illustrating an embodiment of the present invention.

The side view of FIG. 1 shows an embodiment of an electrically operated steam iron 1 having an electric power supply cord 3 on the upper side of the rear part of the iron's plastic housing 2 for connection to the domestic supply. The U-shaped housing 2 forms a handle 4 with a hollow interior which, providing a grip opening 5, is connected with the appliance base 8 through a front post 6 having a hollow interior and an equally interiorly hollow rear post 7. The plane rear side of the rear post which is provided with ribs to obtain a surface profile serves as a heel rest when the iron is placed down in a vertical position. Affixed to the underside of the base 8 widening downwardly in skirt fashion is a stainless steel soleplate 9 having a substantially plane undersurface and provided with steam vents, said soleplate being heatable to temperatures up to the order of about 250° C. via electric heating elements not shown. Above the base is a water reservoir 10 which may be of detachable design and whose contents are selectively usable for the generation of steam exiting from the soleplate 9 or for wetting the material being ironed through a spray nozzle 11 which is connected to a pump actuatable by pressing down an actuating member 12. A thermostat is provided to control the temperature of the soleplate 9, the desired temperature being preselectable with a selector dial 13 arranged on the upper side of the water reservoir 10 to suit the particular type of article being ironed.

Mounted in an essentially upright position in the interior of the rear post 7 is a PC board 15 with the electronic components for an electrically operable residual heat warning device 16 comprising a light emitting diode 17 drivable by the PC board 15, said diode being arranged behind a transparent plastic window 18 in the interior of the handle 4 in front of the handle's gripping area defined by the grip opening 5. It will be appreciated that alternatively or additionally visual signal devices such as light emitting diodes may also be arranged at other readily visible placed on the iron as, for example, at the placed identified by (*) at the rear end of the handle, at the end of the rear post in the area close to the base or on the underside of the iron in the area of the recess provided at the rear end of the soleplate.

Figure 2:
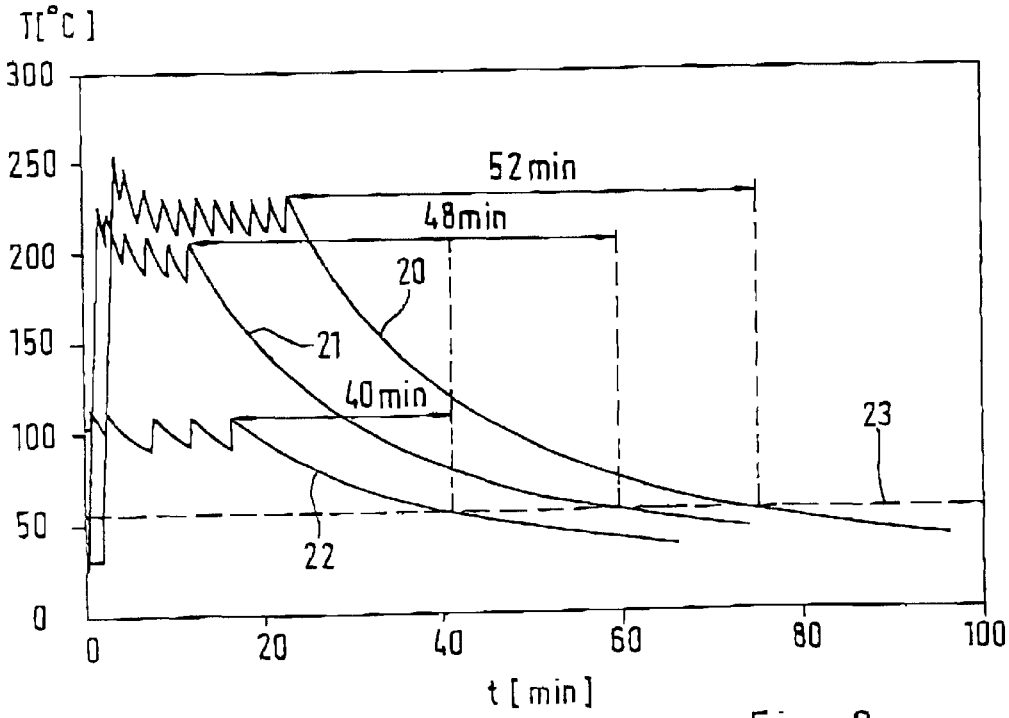
FIG. 2 is a graph showing three typical cooling curves for a pressing iron of the type illustrated in FIG. 1.

For use, the steam iron which has no separate On/Off switch is connected to the domestic supply by inserting a plug provided at the end of the power cord 3 into an electrical outlet and adjusting the desired temperature setting by means of the selector dial 13. The light emitting diode 17 indicates, among other conditions, the On/Off heating condition of the appliance by shining steadily or remaining extinguished, as applicable. When the selected soleplate temperature is reached, the light emitting diode 17 which has been producing a steady emission of light during the heating cycle will be extinguished. The selected temperature is maintained with minor deviations (FIG. 2) until either the thermostat is adjusted to a lower setting or the appliance is unplugged from the supply. Then the soleplate serving as heat emitting element cools off exponentially as illustrated schematically in the cooling curves 20, 21, 22 of FIG. 2. The cooling curve shape is essentially repeatable for each iron and substantially dependent on the temperature prevailing the moment the heating unit is turned off, on the surface properties of the radiating soleplate 9, in particular its size and radiation capacity, on the soleplate mass determining the heat storage capacity, and on the ambient temperature. The cooling curves of FIG. 2 which have been determined empirically for a typical room temperature of 20° C. show that, proceeding from a temperature of about 230° C. which corresponds to the highest setting of the temperature selector dial 13, the soleplate temperature has dropped to a threshold temperature 23 of about 60° C. indicated by the horizontal broken line, after a cooling period of about 52 minutes. At temperatures near or below the threshold temperature 23 it is safe to touch the soleplate for a brief moment or bring it into contact with heat sensitive objects such as plastic parts or the like without the risk of damage. Proceeding from a cutoff temperature of about 200° C. (cooling curve 21), the corresponding cooling period for the same iron is about 48 minutes, while amounting to only 40 minutes maximum starting from a temperature of about 100° C. (cooling curve 22). Tests performed with conventional pressing irons under typically prevailing ambient conditions have revealed that after a cooling period of no more than about one hour the soleplate will generally have cooled off to a degree presenting no longer any hazard.

Figure 3:
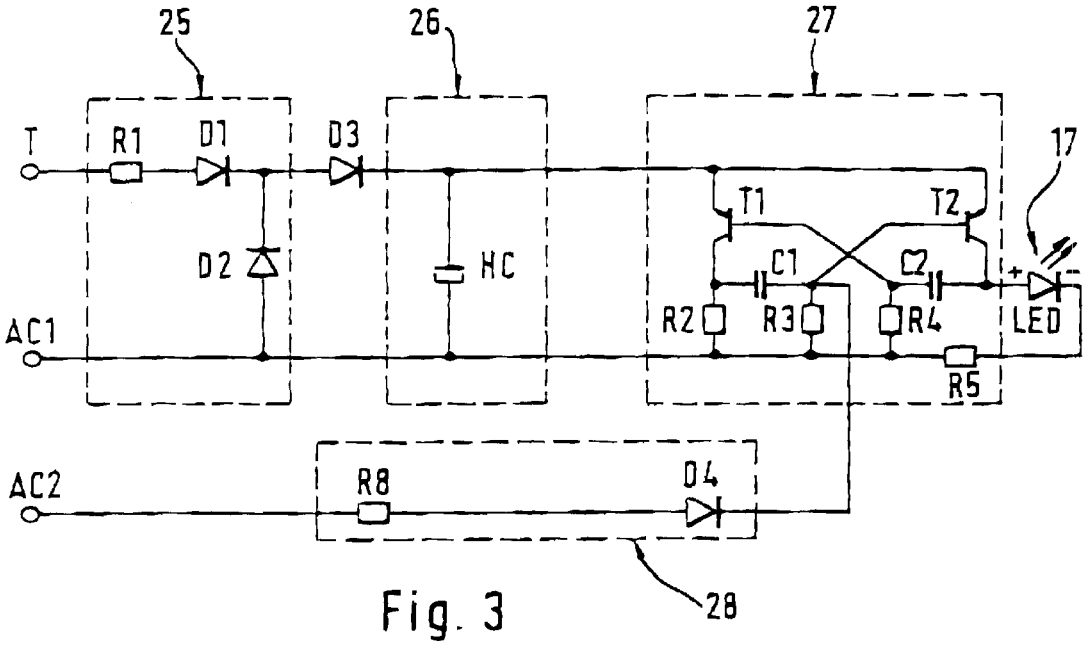
FIG. 3 shows a simplified electronic circuit implementation of the residual heat warning device.

At temperatures above the threshold temperature 23 touching the soleplate 9 may be painful and cause burns, or there is a risk that objects brought into contact with the soleplate may be damaged. To avoid these risks, a user is warned by the residual heat warning device 16 whose light emitting diode 17 produces a flashing warning signal, in particular also with the iron unplugged, when the time elapsed after unplugging or turning off of the heating unit is still insufficient to allow the soleplate to cool off to safe temperatures below the threshold temperature. The circuitry, shown in FIG. 3, for the residual heat warning device 16 which is arranged on the PC board 15 is of modular design. It is connectable via the power cord 3 and the AC terminals AC1 and AC2 to alternating voltage and include a power supply module 25 connected to the thermostat T and further connected modules which include an energy storage module 26 and a driver module or flashing module 27 via which the light emitting diode 17, designated as LED in FIG. 3, is adapted to be driven. A plug-in detector module 28 connected between the terminal AC2 and the driver module 27 is operable to deenergize the flashing module 27 with the plug in inserted condition.

The power supply module 25 supplies electric power to all components of the circuitry. The resistor R1 connected to the thermostat T limits the current through the voltage stabilizing diode D2 connected between the thermostat and the terminal AC1. The diode D1 connected in series with the resistor R1 allows passage of only the positive halfwaves of the connected alternating voltage. The diode D3 connected between the power supply device 25 and the energy storage device 26 prevents discharging of the energy storage unit 26 through the components of the power supply 25.

The electric energy storage device 26 is essentially comprised of an electrolytic capacitor HC which is connected in parallel to the terminals T and AC1 and, being a high capacitance capacitor, may have a capacitance of 0.1 fared, approximately. As long as the circuit is connected to AC voltage, this enables electric energy to be stored in amounts sufficient for operation of the subsequently explained device for energization of the light emiting diode 17 reliably and independently of the line for periods of time appreciably longer than one hour. At all events, the storage energy is designed to ensure operation of the warning light 17 until the pressing iron has cooled off sufficiently also under adverse cooling conditions and starting from maximum temperatures. The use of a capacitor as energy storage medium enables a very straight-forward circuit architecture of the energy storage device 26, because it eliminates the need for devices limiting the charging current or the like, as may be necessary with secondary batteries which are equally possible. Furthermore, the number of charges of a capacitor is basically unlimited, without there occurring a significant change in storage capability, which enables the service life of the residual heat warning device 16 to be as long as that of the pressing iron.

In the flashing module 27 connected downstream of the energy storage device 26, the capacitor C1 and the resistors R2, R3 define the time interval during which the light emitting diode 17 is off, while the capacitor C2 and the resistor R4 are designed to define the duration of the on period. The transistors T1, T2 serve to switch between the on and the off states. The resistor R5 serves to limit the current through the light emitting diode 17.

The circuitry operates in such a way that with the plug inserted, that is, the line voltage connected, and the thermostat in closed condition, the capacitor HC of the energy storage device 26 is charged, with the light emitting diode 17 being illuminated. Hence a heating phase is indicated by continuous illumination of the light emitting diode 17. With the appliance continuing to be plugged in and the thermostat in open condition, the energy storage 26 retains its charge at the stable level, while the light emitting diode 17 is off. When the plug-in detector module 28 detects that the electrical appliance is disconnected from the line, the capacitor HC will start discharging, independently of the position of the thermosat, through the flashing device 27 driving the light emitting diode 17 intermittently, that is, causing it to flash.

The duration of time for which the flashing warning signal is issued may be predetermined to between 60 to 70 minutes, for example, by appropriately adjusting the capacitance of the storage medium HC and the consumption of the light emitting diode 17 and the flashing device 27 provided for driving the light emitting diode. It is also possible to make provision for a timing element (not shown) which turns off the issuance of the warning signal after a predeterminable period of time. In particular at low starting temperatures the exclusively time-dependent control of the warning signal may cause the warning signal to be still active although the temperature has fallen below the threshold temperature for a while already. This adds to the safety margin. At all events it is ensured that warning signals are produced at temperatures above the threshold temperature. Further, it is possible for the residual heat warning device operating independently of the line voltage to be coupled to a thermocouple or the like for monitoring the temperature of the soleplate so that the warning device can be turned off when the soleplate's temperature drops below the threshold temperature.

Figure 4:
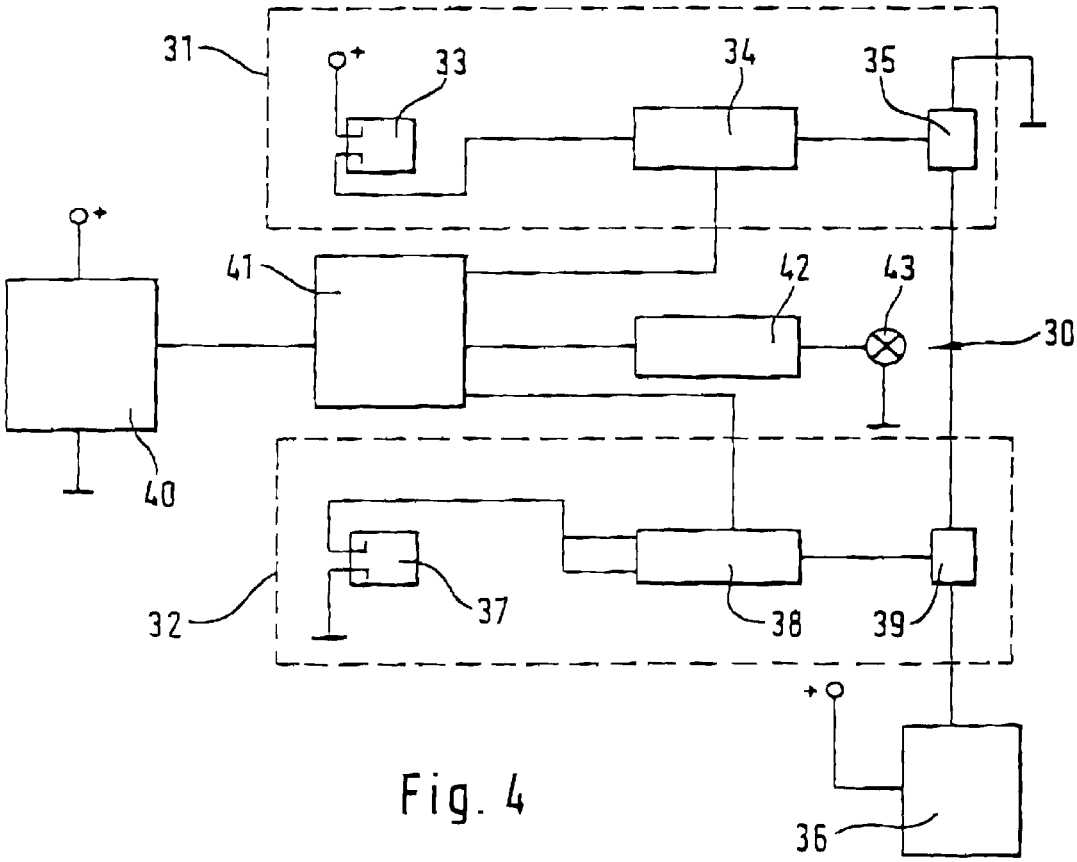
FIG. 4 is a block diagram of a residual heat warning device cooperating with devices for sensing position and movement of the pressing iron.

FIG. 4 is a simplified schematic block diagram depicting another residual heat warning device 30 which acts in cooperation with a vertical position module 31 and a horizontal position module 32 of a condition sensing device of the pressing iron which is designed to deliver a condition signal dependent on the iron's position and/or movement or acceleration, said condition signal being adapted to effect deenergization of the heating unit and/or the issuance of an alarm signal of the audible type, for example. The vertical position module has a vertical position sensor 33 connectable to the positive terminal of a DC source and issuing a vertical position signal when the iron is brought into a vertical position sitting, for example, on the plane rear end of its rear post 7. The vertical position signal triggers a vertical position timer 34 driving a driver 35 after a predeterminable period of time of, for example, 5 minutes, so that the iron's heating unit is de-energized via the power controller 36 connected to the driver also in cases where the plug is connected to the outlet. The horizontal position module 32 has a combined horizontal position and movement sensor 37 connected to chassis and to a horizontal position timer 38 which is equally adapted to drive the power controller 36 via a driver 39. The circuit may be configured such that when the pressing iron remains in a horizontal position for about 30 seconds without being moved, the driver 39 operates to effect a turn-off signal for the heating unit to prevent, for example, the article being ironed from becoming burnt or scorched if the iron is left unattended. By contrast, the movement or acceleration sensor effects a reset signal as soon as the pressing iron is moved again, so that temporary pauses during ironing do not result in the heating unit being turned off.

With suitable modifications the residual heat warning device 30 may be configured in a manner similar to the warning device 16 of FIG. 3. It may have a storage device 41 comprising a storage capacitor connected to the power supply 40, said capacitor being able to supply electric energy to a connected flashing device 42 with light emitting diode 43 also with the appliance unplugged or the heating unit turned off. In contrast to the residual heat warning device 16 of FIG. 3, the residual heat warning device 30 is connected to the timers 34 and 38 of the vertical and horizontal position module, respectively, through a signal line. The circuit may be configured in such fashion that the light emitting diode 43 flashes when the corresponding module issues an alarm signal with the iron in the vertical or horizontal position. In addition to this, the alarm function previously described may also be performed, in which the light emitting diode 43 is caused to flash with the heating unit turned off or the appliance plug pulled for as long as the soleplate temperature still is or is likely to be above the thereshold temperature.

The advantages of line independent residual heat warning devices of the type described in the foregoing or a corresponding type may not only be used in connection with pressing irons but generally with any suitable electrical appliance having a preferably electrically heatable heat emitting body which, as it cools, presents the risk of damage or injury. Thus it is possible, for example, to provide a residual heat warning device, in particular one using a capacitor as energy storage medium, in a table top grill, a waffle iron, an electrically operable frying pan or other devices of that type.

What is claimed is:

1. A pressing iron adapted to receive a line voltage, the pressing iron comprising:

an electrically heatable soleplate heatable by connection to the line voltage; and a residual heat warning device for continuously issuing at least one temperature-independent warning signal for a predetermined time interval when the electrically heatable soleplate is disconnected from the line voltage, said predetermined time interval beginning and ending independently of any measured temperature of the soleplate.

2. The pressing iron as claimed in claim 1, wherein the residual heat warning device is operable independently of the pressing iron receiving the line voltage.

3. The pressing iron as claimed in claim 2, further comprising a housing and an electric power supply cord affixed thereto for receiving the line voltage.

4. The pressing iron as claimed in claim 2, wherein the residual heat warning device is electrically operable, the residual heat warning device further comprising at least one storage device for the storage of electric energy to supply the residual heat warning device with energy.

5. The pressing iron as claimed in claim 4, wherein the at least one storage device is configured such as to be rechargeable when the power cord of the pressing iron is connected to the line voltage.

6. The pressing iron as claimed in claim 5, wherein the at least one storage device includes at least one capacitor.

7. The pressing iron of claim 6, wherein the at least one capacitor comprises at least one high capacitance capacitor, with a capacitance of more than 0.05 farad.

8. The pressing iron of claim 7, wherein the at least one capacitor comprises at least one high capacitance capacitor, with a capacitance of between about 0.08 and about 1.2 farad.

9. The pressing iron as claimed in claim 6, wherein the residual heat warning device includes at least one visual signal device.

10. The pressing iron of claim 9, wherein the at least one visual signal device comprises a light emitting diode.

11. The pressing iron of claim 10, wherein the light emitting diode is operable intermittently to produce a continuously flashing warning signal for the predetermined time interval.

12. The pressing iron as claimed in claim 1, wherein said predetermined time interval coincides with an empirically determined cooling period of the soleplate down to a non-critical, cooler temperature.

13. The pressing iron as claimed in claim 12, wherein the pressing iron further comprises a temperature selector dial for controlling a temperature setting of the soleplate, and wherein the predetermined time interval during which the residual heat warning device issues the warning signal is dependent on the temperature setting adjusted with the temperature selector dial when the heatable soleplate is disconnected from the line voltage.

14. The pressing iron as claimed in claim 13, wherein the residual heat warning device includes a timing element by means of which the issuance of the warning signal is controlled as a function of time and which determines the predetermined time interval.

15. The pressing iron as claimed in claim 13, wherein the residual heat warning device delivers a warning signal correlating with the instantaneous temperature of the soleplate independently of that temperature.

16. The pressing iron of claim 12, wherein the predetermined time interval during which the residual heat warning device continuously issues the warning signal is dependent on a maximum possible temperature of the soleplate.

17. The pressing iron as claimed in claim 1, further comprising at least one condition sensing device designed to deliver a condition signal dependent on the position and/or the movement of the pressing iron, and that the residual heat warning device is operable in dependence on said condition signal.

18. The pressing iron as claimed in claim 17, wherein the residual heat warning device is configured in such manner that in cases where a critical temperature threshold lying above the threshold temperature is exceeded, the residual heat warning device issues a warning signal also when the temperature subsequently drops below the threshold value.

19. The pressing iron as claimed in claim 1, wherein the residual heat warning device includes at least one visual signal device which is arranged in the area of an upper side of the pressing iron.

20. The pressing iron of claim 19, further comprising a handle attached in the area of the upper side of the iron, the at least one visual signal device being arranged on or within the handle.

21. The pressing iron of claim 1, wherein the residual heat warning device includes at least one visual signal device which is arranged on an underside of the pressing iron.

22. The pressing iron of claim 21, wherein the at least one visual signal device is arranged at a location adjacent to the soleplate.

23. A residual heat warning device for the issuance of at least one warning signal for a predetermined time interval, the warning device being associated with an electrically heatable heat emitting body of an electrical appliance, the warning device being activated when the electrically heatable heat emitting body is no longer being heated, the residual heat warning device comprising a signal, a timer and an electrical storage device, wherein the warning signal, the predetermined time interval and activation of the warning signal are all independent of any measured temperature of the electrically heatable heat emitting body.

24. An electrical appliance with at least one heat emitting body, the heat emitting body being heatable by connection with a line voltage, the electrical appliance further comprising a residual heat warning device operable independently of the line voltage and designed to deliver at least one warning signal for a predetermined time interval when the temperature of the heat emitting body exceeds a threshold temperature and the heat emitting body is disconnected from the line voltage, wherein the warning signal, the predetermined time interval and activation of the warning signal are all independent of any measured temperature of the electrically heatable heat emitting body.

* * * * *